US008893333B2

(12) United States Patent
Soto et al.

(10) Patent No.: US 8,893,333 B2
(45) Date of Patent: Nov. 25, 2014

(54) SURGICAL HEAD SUPPORT APPARATUS

(75) Inventors: Orlando Soto, Acton, MA (US); Dustin T. Libby, Belmont, MA (US); Thomas K. Skripps, Acton, MA (US)

(73) Assignee: Allen Medical Systems, Inc., Batesville, IN (US)

( * ) Notice: Subject to any disclaimer, the term of this patent is extended or adjusted under 35 U.S.C. 154(b) by 699 days.

(21) Appl. No.: 12/948,815

(22) Filed: Nov. 18, 2010

(65) Prior Publication Data

US 2012/0124748 A1 May 24, 2012

(51) Int. Cl.
*A47G 9/10* (2006.01)
*A61G 13/12* (2006.01)
*A61G 13/10* (2006.01)

(52) U.S. Cl.
CPC ..... *A61G 13/121* (2013.01); *A61G 13/101* (2013.01); *A61G 13/129* (2013.01)
USPC ..... 5/640; 5/636; 5/637; 5/658

(58) Field of Classification Search
USPC ..... 5/636, 640, 637, 639, 638, 643
See application file for complete search history.

(56) References Cited

U.S. PATENT DOCUMENTS

| | | | |
|---|---|---|---|
| 320,806 | A | 6/1885 | Long |
| 933,471 | A | 9/1909 | Leahy |
| 1,728,025 | A | 9/1929 | Weber |
| 2,306,031 | A | 12/1942 | Anderson et al. |
| 2,452,816 | A | 11/1948 | Wagner |
| 2,509,086 | A | 5/1950 | Eaton |
| 2,688,142 | A | 9/1954 | Jensen |
| 3,042,025 | A | 7/1962 | Jackson |
| 3,099,441 | A | 7/1963 | Ries |
| 3,188,079 | A | 6/1965 | Boetcker et al. |
| 3,223,447 | A | 12/1965 | Terracini |
| 3,572,835 | A | 3/1971 | Kees, Jr. et al. |
| 3,609,779 | A | 10/1971 | Oja et al. |
| 3,828,377 | A | 8/1974 | Fary, Sr. |
| 3,854,772 | A | 12/1974 | Abrahamson et al. |
| 3,897,777 | A | 8/1975 | Morrison |
| 3,947,686 | A | 3/1976 | Cooper et al. |
| 3,957,262 | A | 5/1976 | McReynolds |
| 4,018,412 | A | 4/1977 | Kees, Jr. et al. |
| 4,021,028 | A | 5/1977 | Weber et al. |
| 4,033,339 | A | 7/1977 | Roberts et al. |
| 4,034,748 | A | 7/1977 | Winner |
| 4,054,282 | A | 10/1977 | Hamer |

(Continued)

FOREIGN PATENT DOCUMENTS

WO WO 2005/020819 3/2005

OTHER PUBLICATIONS

2005 Catalog Passionate About Positioning, Allen Medical Systems, A Hill-Rom Company; dated Dec. 2004.

*Primary Examiner* — Brittany Wilson
(74) *Attorney, Agent, or Firm* — Barnes & Thornburg LLP

(57) ABSTRACT

A surgical head support apparatus includes a headrest, a bracket, and a joint member. The headrest includes a first spherical joint and the bracket includes a second spherical joint. The joint member includes a joint lock. The joint member couples the headrest to the bracket. The joint lock moves the joint member between a locked and an unlocked configuration. In the locked configuration, the joint member disallows movement of the headrest relative to the bracket. In the unlocked configuration, the joint member allows movement of the headrest relative to the bracket.

20 Claims, 5 Drawing Sheets

(56) References Cited

U.S. PATENT DOCUMENTS

| | | | |
|---|---|---|---|
| 4,108,426 | A | 8/1978 | Lindstroem et al. |
| 4,139,917 | A | 2/1979 | Fenwick |
| 4,169,478 | A | 10/1979 | Hickmann |
| 4,225,125 | A | 9/1980 | Lee |
| 4,243,025 | A | 1/1981 | Jones |
| 4,378,108 | A | 3/1983 | Bailey, Jr. |
| 4,387,888 | A | 6/1983 | Marinakis |
| D271,834 | S | 12/1983 | Huntsinger |
| 4,474,364 | A | 10/1984 | Brendgord |
| 4,484,911 | A | 11/1984 | Berlin et al. |
| 4,504,050 | A | 3/1985 | Osborne |
| 4,526,355 | A | 7/1985 | Moore et al. |
| 4,545,572 | A | 10/1985 | Day |
| 4,620,697 | A | 11/1986 | Pithon |
| 4,671,728 | A | 6/1987 | Clark et al. |
| 4,678,232 | A | 7/1987 | Ishida et al. |
| 4,752,064 | A | 6/1988 | Voss |
| 4,757,983 | A | 7/1988 | Ray et al. |
| 4,823,776 | A | 4/1989 | Foster et al. |
| 4,840,363 | A | 6/1989 | McConnell |
| 4,852,840 | A | 8/1989 | Marks |
| 4,865,484 | A | 9/1989 | McConnell |
| 4,923,187 | A | 5/1990 | Mombrinie |
| 4,979,519 | A | 12/1990 | Chavarria et al. |
| 4,989,848 | A | 2/1991 | Monroe |
| 4,995,067 | A | 2/1991 | Royster et al. |
| 5,081,665 | A | 1/1992 | Kostich |
| 5,088,706 | A | 2/1992 | Jackson |
| 5,131,106 | A | 7/1992 | Jackson |
| 5,177,823 | A | 1/1993 | Riach |
| 5,207,716 | A | 5/1993 | McReynolds et al. |
| 5,214,815 | A | 6/1993 | Agbodoe et al. |
| 5,220,699 | A | 6/1993 | Farris |
| 5,233,713 | A | 8/1993 | Murphy et al. |
| 5,269,035 | A | 12/1993 | Hartunian |
| 5,276,927 | A | 1/1994 | Day |
| 5,317,771 | A | 6/1994 | Cook |
| 5,408,713 | A | 4/1995 | Stratton et al. |
| 5,427,436 | A | 6/1995 | Lloyd |
| 5,444,882 | A | 8/1995 | Andrews et al. |
| 5,515,867 | A | 5/1996 | Lamb |
| 5,520,623 | A | 5/1996 | Williams |
| 5,524,639 | A | 6/1996 | Lanier et al. |
| 5,531,229 | A | 7/1996 | Dean et al. |
| 5,564,663 | A | 10/1996 | Cook et al. |
| 5,569,175 | A | 10/1996 | Chitwood |
| 5,613,254 | A | 3/1997 | Clayman et al. |
| 5,613,501 | A | 3/1997 | Michelson |
| 5,615,432 | A | 4/1997 | Von Ohlen, III |
| 5,642,302 | A | 6/1997 | Dumont et al. |
| 5,661,859 | A | 9/1997 | Schaefer |
| 5,741,210 | A | 4/1998 | Dobrovolny |
| 5,758,374 | A | 6/1998 | Ronci |
| 5,916,189 | A | 6/1999 | Sullenperger et al. |
| 5,926,876 | A | 7/1999 | Haigh et al. |
| D414,974 | S | 10/1999 | Marrone, II et al. |
| 5,960,494 | A | 10/1999 | Gilliland et al. |
| 6,065,165 | A | 5/2000 | Delk et al. |
| 6,076,208 | A | 6/2000 | Heimbrock et al. |
| 6,108,840 | A | 8/2000 | Heimbrock et al. |
| 6,112,333 | A | 9/2000 | Mazzei |
| 6,120,397 | A | 9/2000 | Julian |
| 6,138,302 | A | 10/2000 | Sashin et al. |
| 6,138,304 | A | 10/2000 | Lipsky et al. |
| 6,151,734 | A | 11/2000 | Lawrie |
| 6,154,903 | A | 12/2000 | Wai-Chung |
| 6,199,552 | B1 | 3/2001 | Crespo |
| 6,202,230 | B1 | 3/2001 | Borders |
| 6,249,923 | B1 | 6/2001 | Heimbrock et al. |
| 6,260,220 | B1 | 7/2001 | Lamb et al. |
| 6,276,012 | B2 | 8/2001 | Borders |
| 6,374,439 | B2 | 4/2002 | Heimbrock et al. |
| 6,397,414 | B1 | 6/2002 | Lloyd |
| 6,427,273 | B1 | 8/2002 | Berke et al. |
| 6,442,777 | B1 | 9/2002 | Pauli |
| 6,446,287 | B2 | 9/2002 | Borders |
| 6,490,737 | B1 | 12/2002 | Mazzei et al. |
| 6,510,852 | B1 | 1/2003 | Shiery et al. |
| 6,532,609 | B2 | 3/2003 | Taylor et al. |
| 6,557,195 | B2 | 5/2003 | Dinkler |
| 6,561,194 | B2 | 5/2003 | Michelson |
| 6,564,406 | B2 | 5/2003 | VanSteenburg et al. |
| 6,578,215 | B1 | 6/2003 | Heimbrock et al. |
| 6,594,839 | B1 | 7/2003 | Papay |
| 6,616,236 | B1 | 9/2003 | Su |
| 6,622,324 | B2 | 9/2003 | VanSteenburg et al. |
| 6,637,058 | B1 | 10/2003 | Lamb |
| 6,701,553 | B1 | 3/2004 | Hand et al. |
| 6,718,580 | B2 | 4/2004 | Heimbrock et al. |
| 6,718,582 | B1 | 4/2004 | Tinsley |
| 6,739,006 | B2 | 5/2004 | Newkirk et al. |
| 6,754,923 | B2 | 6/2004 | Borders et al. |
| D497,430 | S | 10/2004 | Tinsley |
| 6,928,676 | B1 | 8/2005 | Schwaegerle |
| 7,017,211 | B2 | 3/2006 | Krywiczanin et al. |
| 7,089,613 | B2 | 8/2006 | Cohen |
| 7,117,551 | B1 | 10/2006 | Dinkler et al. |
| 7,407,231 | B2 | 8/2008 | Kraft et al. |
| 7,544,007 | B2 | 6/2009 | Easton |
| 7,770,977 | B2 | 8/2010 | Diller |
| 7,882,583 | B2 | 2/2011 | Skripps |
| 2002/0061225 | A1 | 5/2002 | Boucher et al. |
| 2002/0169460 | A1* | 11/2002 | Foster et al. ..... 606/130 |
| 2003/0115674 | A1 | 6/2003 | Heimbrock et al. |
| 2003/0178880 | A1* | 9/2003 | Hannah ..... 297/406 |
| 2004/0123389 | A1 | 7/2004 | Boucher et al. |
| 2006/0253985 | A1 | 11/2006 | Skripps |
| 2008/0078031 | A1 | 4/2008 | Weinstein et al. |
| 2009/0079251 | A1 | 3/2009 | Diller |

* cited by examiner

SURGICAL HEAD SUPPORT APPARATUS

BACKGROUND

The present disclosure relates to a patient support apparatus, for supporting a patient during surgery. More particularly, the present disclosure relates to a surgical head support apparatus for use during a variety of surgical operations such as shoulder surgery, clavicle repair, breast augmentation, or other surgeries.

Often, when a patient is sedated for a surgery, the patient is supported by and secured to braces or supports coupled to a surgical table. Sometimes, while the patient is sedated, it is desirable to move a patient's head to a variety of positions.

Surgical supports known in the art are configured to allow repositioning of the patient's head during surgery. Some such supports have a variety of mechanical joints connecting a head support to a surgical table. Sometimes, surgical supports known in the art require more than one caregiver and several steps to move the patient's head to a desired position.

SUMMARY

A surgical head support apparatus has one or more of the features recited in the appended claims and/or the following features which, alone or in any combination, may comprise patentable subject matter:

A surgical head support apparatus may include a head support including a first spherical joint, a bracket including a second spherical joint, and a joint member coupling the head support to the bracket. The joint member may include a joint member body and a joint lock. The joint member body may have a joint member body first end forming a first socket and a joint member body second end forming a second socket. The first socket may be sized to receive the first spherical joint and the second socket may be sized to receive the second spherical joint. The joint lock may be operable to move the joint member between a locked configuration and an unlocked configuration. In the locked configuration, the joint member may disallow movement of the joint member relative to the first spherical joint and the second spherical joint. In the unlocked configuration, the joint member may allow movement of the joint member relative to the first spherical joint and the second spherical joint.

In some embodiments, the first spherical joint may include a first ball, a first shaft extending from the first ball, and a first flange coupled between the first shaft and the head support so that the shaft forms an angle relative to the head support of less than 90 degrees. The second spherical joint may include a second ball, a second shaft extending from the first ball, and a second flange coupled between the second shaft and the bracket so that the shaft forms an angle relative to the head support of less than 90 degrees.

The first spherical joint may include a first ball and the first ball may be rubberized. The second spherical joint may include a second ball and the second ball may be rubberized.

According to this disclosure, the joint lock may include a joint lock knob. The joint lock knob may be rotatable to move the joint member between the locked configuration and the unlocked configuration.

It is contemplated that the bracket may be U-shaped. The bracket may also include a first rail receiver, a second rail receiver, and a cross member coupled to the first rail receiver and the second rail receiver. The first rail receiver and the second rail receiver may be slidably engaged with an operating room table adapter.

A surgical head support apparatus may have a head support including a first spherical joint, a bracket including a second spherical joint, and a joint member coupled between the head support and the bracket. The joint member may include a joint member body. The joint member body may have a first joint member body portion and a second joint member body portion. The first spherical joint and the second spherical joint may be situated between the first joint member body portion and the second joint member body portion. The first joint member body portion and the second joint member body portion may be movable between a first position and a second position. In the first position, the first joint member body portion and the second joint member body portion may be spaced apart a first distance and may disallow movement of the joint member body relative to the first spherical joint and the second spherical joint. In the second position, the first joint member body portion and the second joint member body portion may be spaced apart more than the first distance and may allow movement of the joint member body relative to the first spherical joint and the second spherical joint.

In some embodiments, the joint member may further include a joint lock operable to move the first joint member body portion and the second joint member body portion between the first and the second position. The joint lock may include a joint lock bolt, extending through the first joint member body portion and the second joint member body portion, and a joint lock knob threadedly engaged with an end of the joint lock bolt.

It is contemplated that the first spherical joint may include a first ball, a first shaft extending from the first ball, and a first flange coupled between the first shaft and the head support so that the shaft forms an angle relative to the head support of less than 90 degrees. Further, the second spherical joint may include a second ball, a second shaft extending from the second ball, and a second flange coupled between the second shaft and the bracket so that the shaft forms an angle relative to the head support of less than 90 degrees.

According to this disclosure, the first spherical joint may include a first ball and the first ball may be rubberized. The second spherical joint may include a second ball and the second ball may be rubberized.

In some embodiments, the joint member body may include a first socket sized to receive the first spherical joint and a second socket sized to receive the second spherical joint, the first socket and the second socket may be defined by the first joint member body portion and the second joint member body portion.

A surgical head support apparatus may include a head support including a first head support handle, a second head support handle, and a headrest coupled between the first head support handle and the second head support handle. Such a surgical head support apparatus further may include a bracket and a joint member coupling the head support to the bracket for movement in three dimensions relative thereto. The first head support handle and the second head support handle may extend in a plane tangent to a curve defined by the headrest. Further, the first head support handle and the second head support handle may extend above a top surface of the headrest.

According to this disclosure, a bottom surface of the headrest may extend below the first head support handle and the second head support handle. The first head support handle, the second head support handle, and the headrest may be unitarily formed from a polymeric material.

In some embodiments, the head support further may include a first removable head strap and a second removable head strap. The first head strap and the second head strap may include an inner surface and an outer surface. The inner surface may be covered in hook material and the outer surface may be covered in loop material. Additionally, the head support may include a first strap guide opening and a second strap guide opening. The first strap may extend through the first strap guide opening and the second strap may extend through the second strap guide opening.

Additional features, which alone or in combination with any other feature(s), such as those listed above and those listed in the claims, may comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

The detailed description particularly refers to the accompanying figures, in which.

DETAILED DESCRIPTION OF THE DRAWINGS

Figure 1:
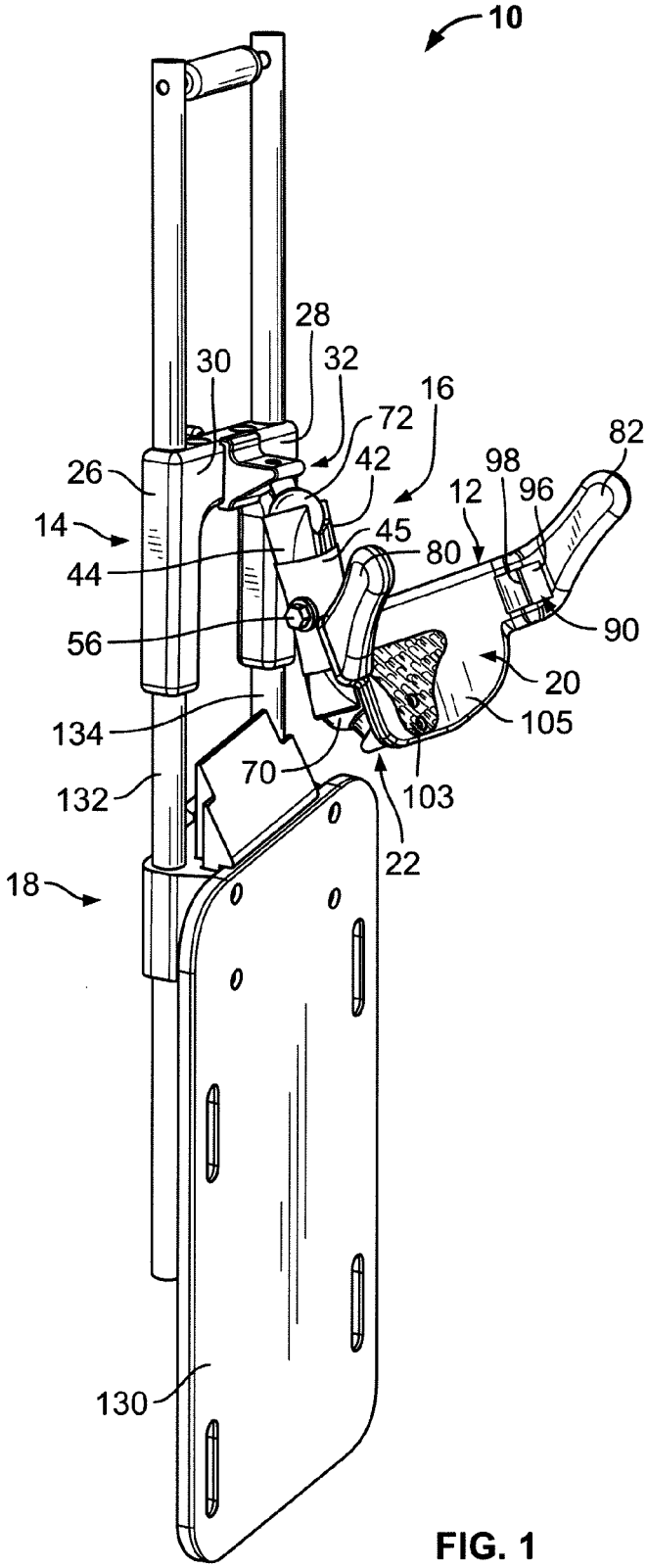
FIG. 1 is a perspective view of a surgical head support apparatus and an operating room table adapter apparatus showing a U-shaped bracket of the head support apparatus coupled to a pair of parallel tubular rails of the operating room table adapter.
Figure 2:
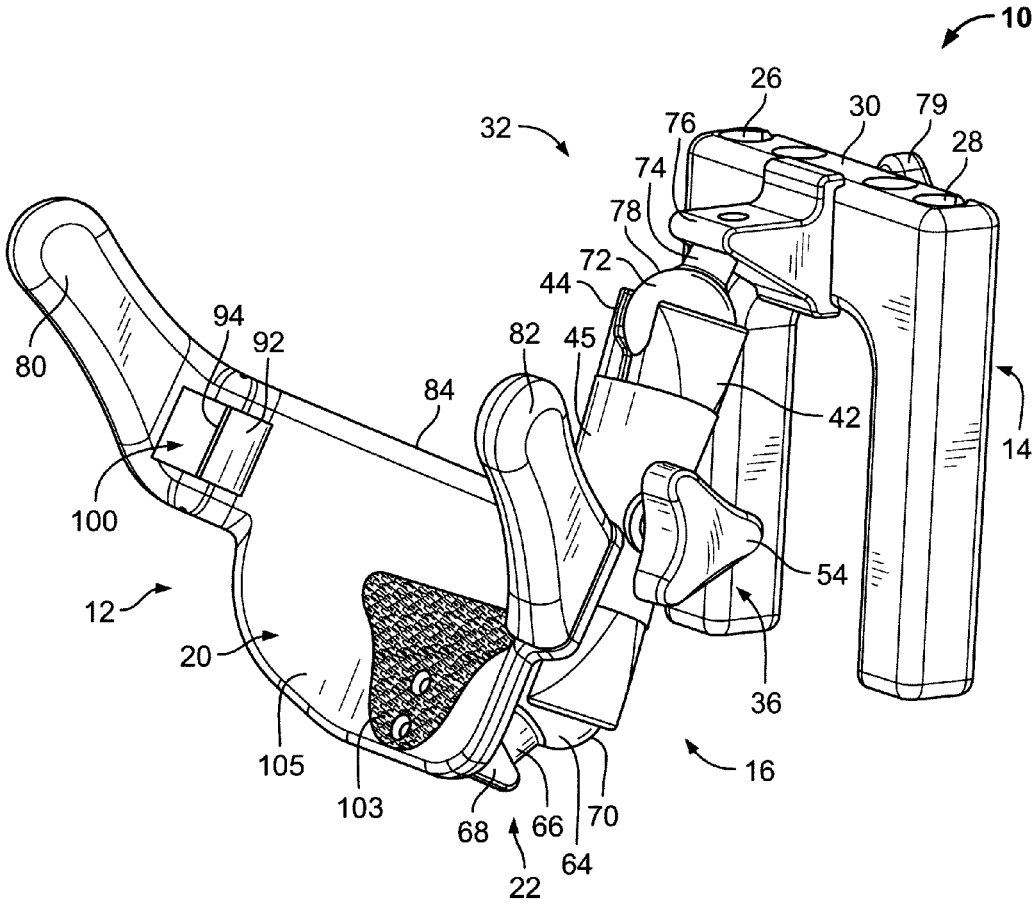
FIG. 2 is an exploded view of the surgical head support apparatus of FIG. 1 showing the components of a joint member between the U-shaped bracket and the head support.

FIG. 1 shows an illustrative surgical head support apparatus 10 for use with a surgical table. The apparatus 10 allows a single caregiver to reposition a patient's head during surgery. The apparatus 10 includes a head support 12, a bracket 14, and a joint member 16. The bracket 14 is slidably coupled to an operating room table adapter 18. The joint member 16 couples the head support 12 to the bracket 14 so that the head support 12 is movable relative to the bracket 14.

The head support 12 includes a curved headrest 20 and a first spherical joint 22. The first spherical joint 22 extends from, and is coupled to, a back surface 24 of the curved headrest 20.

The bracket 14 is U-shaped and includes a first rail receiver 26, a second rail receiver 28, a cross member 30, and a second spherical joint 32. The cross member 30 extends between the first rail receiver 26 and the second rail receiver 28. The second spherical joint 32 extends from and is coupled to the cross member 30. Spherical joints 22, 32, are sometimes referred to as ball joints.

The joint member 16 includes a joint member body 34 and a joint lock 36. The joint member body 34 has a first end 38 and a second end 40 spaced apart from the first end 38. The first spherical joint 22 is movably coupled to the first end 38. The second spherical joint 32 is movably coupled to the second end 40.

The joint member body 34 includes a first portion 42, a second portion 44 which is separate from the first portion 42, and a body wrap 45. The first portion 42 and the second portion 44 are formed to have the same shape and are oriented to be mirror images of one another when assembled. The first portion 42 and the second portion 44 cooperate to form a first socket 46 and a second socket 48. The first socket 46 is situated at the first end 38 of the joint member body 34. The second socket 48 is situated at the second end 40 of the joint member body 34. The first and the second portions 42, 44, of the joint member body 34 include a hole 50 extending through the first and the second portions 42, 44. The body wrap 45 is tubular and is pulled over the assembled first portion 42 and the second portion 44.

The joint lock 36 includes a joint lock bolt 52 and a joint lock knob 54. The joint lock bolt 52 includes a bolt head 56 and a bolt shaft 58. The bolt head 56 is sized for receipt in a hexagonal bore 57 formed in a cylindrical boss 59. The bolt shaft 58 extends through the hole 50 provided in the first and the second portions 42, 44. The bolt shaft 58 includes a threaded portion 60 extending beyond the hole 50 of the first portion 42. The joint lock knob 54 is threadedly coupled to the threaded portion 60 of the joint lock bolt 52 and engages an end surface 61 of the cylindrical boss 59 of the second portion 44 of the joint member body 34.

Figure 4:
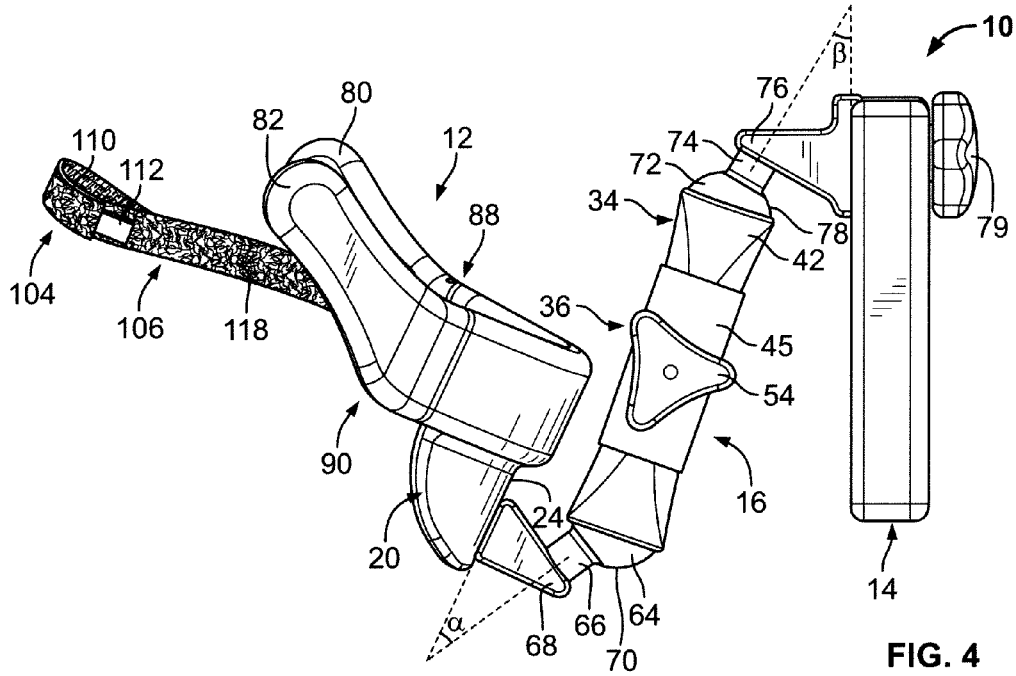
FIG. 4 is a side view of the surgical head support apparatus of FIG. 3 showing a restraint strap extending upwardly from the head support.

The first spherical joint 22 includes a first ball 64, a first shaft 66, and a first flange 68. The first ball 64 has a rubberized outer surface 70. The first shaft 66 extends from the first ball 64. The first flange 68 is coupled between the first shaft 66 and the head support 12 so that the first shaft 66 forms an acute angle $\alpha$, as shown in FIG. 4. In other embodiments, the angle $\alpha$ formed by the first shaft 66 and the head support 12 is greater than, or equal to, 90 degrees. The first flange 68 is coupled to the head support 12 by screws 69. It is contemplated that the first flange 68 is coupled to the head support 12 by other suitable fasteners or adhesives.

The second spherical joint 32 includes a second ball 72, a second shaft 74, and a second flange 76. The second ball 72 has a rubberized outer surface 78. The second shaft 74 extends from the second ball 72. The second flange 76 is coupled between the second shaft 74 and the bracket 14 cross member 30 so that the second shaft 74 forms an acute angle $\beta$, as shown in FIG. 4. In other embodiments, the angle $\beta$ formed by the second shaft 74 and the bracket 14 is greater than, or equal to, 90 degrees. In some embodiments, the angle $\alpha$ is equal to the angle $\beta$. The second flange 76 is coupled to the bracket 14 by knob bolt 79. It is contemplated that the second flange 76 is coupled to the bracket 14 by other suitable fasteners or adhesives.

In some rubberized embodiments, the balls 64, 72, are constructed entirely from an appropriate polymer material. In other rubberized embodiments, the balls 64, 72, are constructed with a core inside an appropriate polymer outer layer. In still other embodiments, the balls 64, 72, are constructed entirely from another material, such as metal.

The first socket 46 is sized to engage more than one half of the first ball 64 with the first shaft 66 extending away from the joint member body 34. The second socket 48 is sized to engage more than one half of the second ball 72 with the second shaft 74 extending away from the joint member body 34. The first ball 64 is situated in the first socket 46 between the first portion 42 and the second portion 44 of the joint member body 34 at the first end 38 of the joint member body 34. The second ball 72 is situated in the second socket 48 between the first portion 42 and the second portion 44 of the joint member body 34 at the second end 40 of the joint member body 34.

The joint lock 36 is operable to move the joint member 16 between a locked configuration and an unlocked configuration. In the locked configuration, the head support 12 is not movable relative to the bracket 14. In the unlocked configuration, the head support 12 is movable in three dimensions relative to the bracket 14.

In the locked configuration, the first portion 42 and the second portion 44 of the joint member body 34 are spaced apart a first distance. Further, in the locked configuration, the first socket 46 and the second socket 48 engage the first ball 64 and the second ball 72, respectively. Thus, in the locked configuration, the first portion 42 and the second portion 44 cooperate to prevent the balls 64, 72, from moving in the first and the second sockets 46, 48. This is due to the concave sockets 46, 48, of portions 42, 44, clamping against balls 70, 72 with sufficient force due to the tightening of the joint lock knob 54 on bolt 52. Loosening the joint lock knob 54 on the bolt 52 unclamps the first and the second sockets 46, 48, from the balls 70, 72.

In the unlocked configuration, the first portion 42 and the second portion 44 of the joint member body 34 are spaced apart more than the first distance. Further, in the unlocked configuration, the first socket 46 and the second socket 48 disengage the first ball 64 and the second ball 72, respectively. Thus, in the unlocked configuration, the first portion 42 and the second portion 44 allow the balls 64, 72, to move in the first and the second sockets 46, 48.

The body wrap 45 includes a void 77 extending through the body wrap 45 and sized to allow the bosses 59 to extend beyond the body wrap 45. The body wrap 45 is operable to prevent the balls 64, 72, from escaping the sockets 46, 48, even when the joint member 16 is in the unlocked configuration and the sockets 46, 48, are unclamped from the balls 64, 72.

The joint lock 36 moves the joint member 16 from the unlocked configuration to the locked configuration when the joint lock knob 54 is rotated in clockwise direction. When the joint lock knob 54 is rotated in the clockwise direction, the bolt head 56 is moved closer to the joint lock knob 54. Thus, the joint lock knob 54 decreases the distance between the first portion 42 and the second portion 44 of the joint member body 34 to the first distance. When the first portion 42 and the second portion 44 of the joint member body 34 are spaced apart the first distance, the first ball 64 and the second ball 72 apply opposing forces to the first and the second portions 42, 44, encouraging them to move apart.

The joint lock 36 moves the joint member 16 from the locked configuration to the unlocked configuration when the joint lock knob 54 is rotated in counter-clockwise direction. The opposing forces applied by the first ball 64 and the second ball 72 on the first portion 42 and the second portion 44 of the joint member body 34 act to move the first and the second portions 42, 44, apart. Thus, the joint lock knob 54 increases the distance between the first portion 42 and the second portion 44 of the joint member body 34 to a distance greater than the first distance.

In some embodiments, the joint lock bolt 52 shaft and the joint lock knob 54 are threaded with left-hand threads. In such embodiments, the direction of joint lock knob 54 rotation to move the first portion 42 and the second portion 44 of the joint member body 34 between the first and the unlocked configuration is reversed.

The head support 12 includes a first handle 80 and a second handle 82. The first handle 80 and the second handle 82 extend from the curved headrest 20 and end above the top surface 84 of the curved headrest 20. The curved headrest 20, the first handle 80, and the second handle 82 are unitarily formed from a polymeric material.

The head support 12 also includes a first strap connector 88 and a second strap connector 90. The first strap connector 88 includes a first wall 92 and a first pin 94. The second strap connector 90 includes a second wall 96 and a second pin 98. The first wall 92 and the first pin 94 cooperate to form a first slot 100. The second wall 96 and the second pin 98 cooperate to form a second slot 102. The first and the second walls 92, 96, are coupled between the curved headrest 20 and the first and the second handles 80, 82, respectively. The first and the second walls 92, 96, are unitarily formed with the curved headrest 20 and the first and the second handles 80, 82, from a polymeric material.

Figure 3:
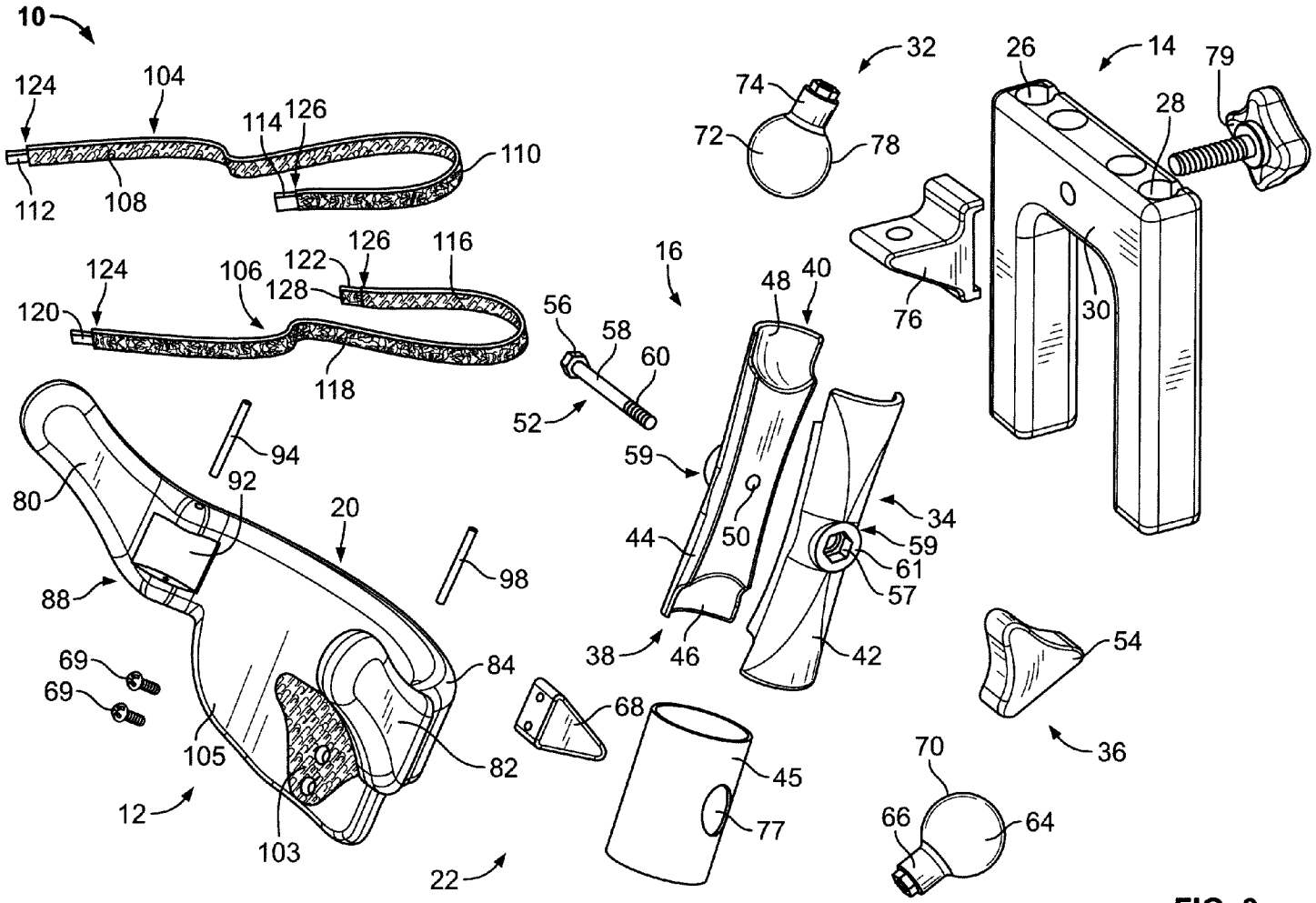
FIG. 3 is a perspective view of the surgical head support apparatus of FIG. 1 showing the joint member portions clamped against a first ball and a second ball to lock the head support in place relative to the U-shaped bracket.
Figure 5:
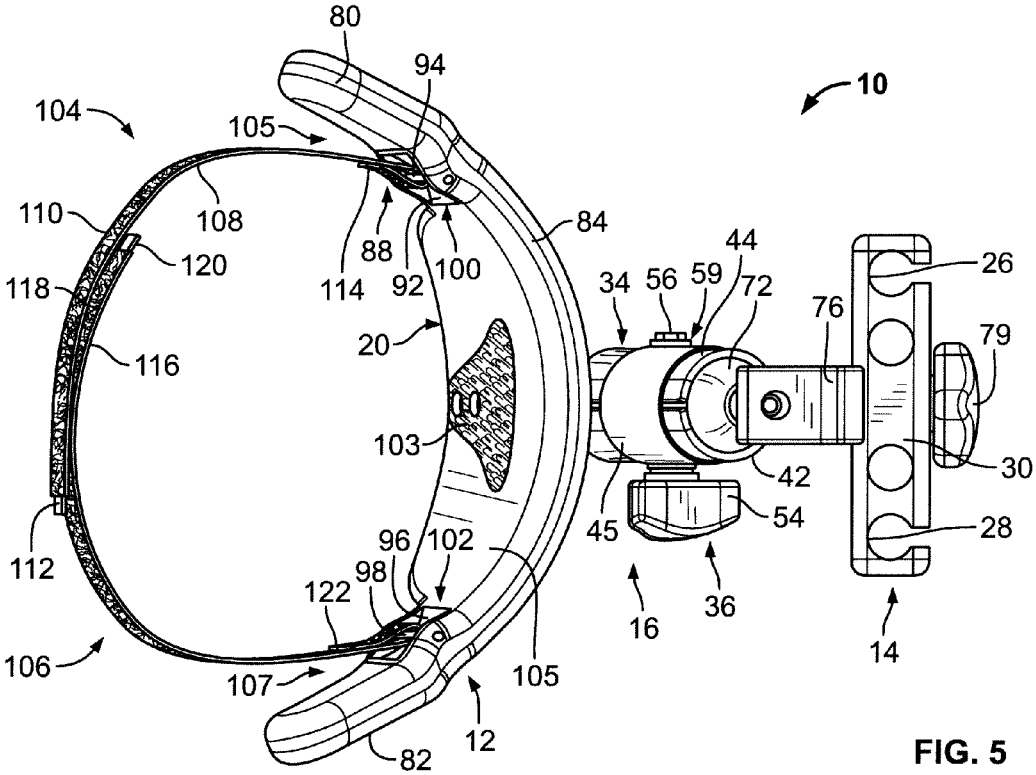
FIG. 5 is a top plan view of the surgical head support apparatus of FIG. 4 showing a pair of restraint straps coupled together to the left of the head support.
Figure 6:
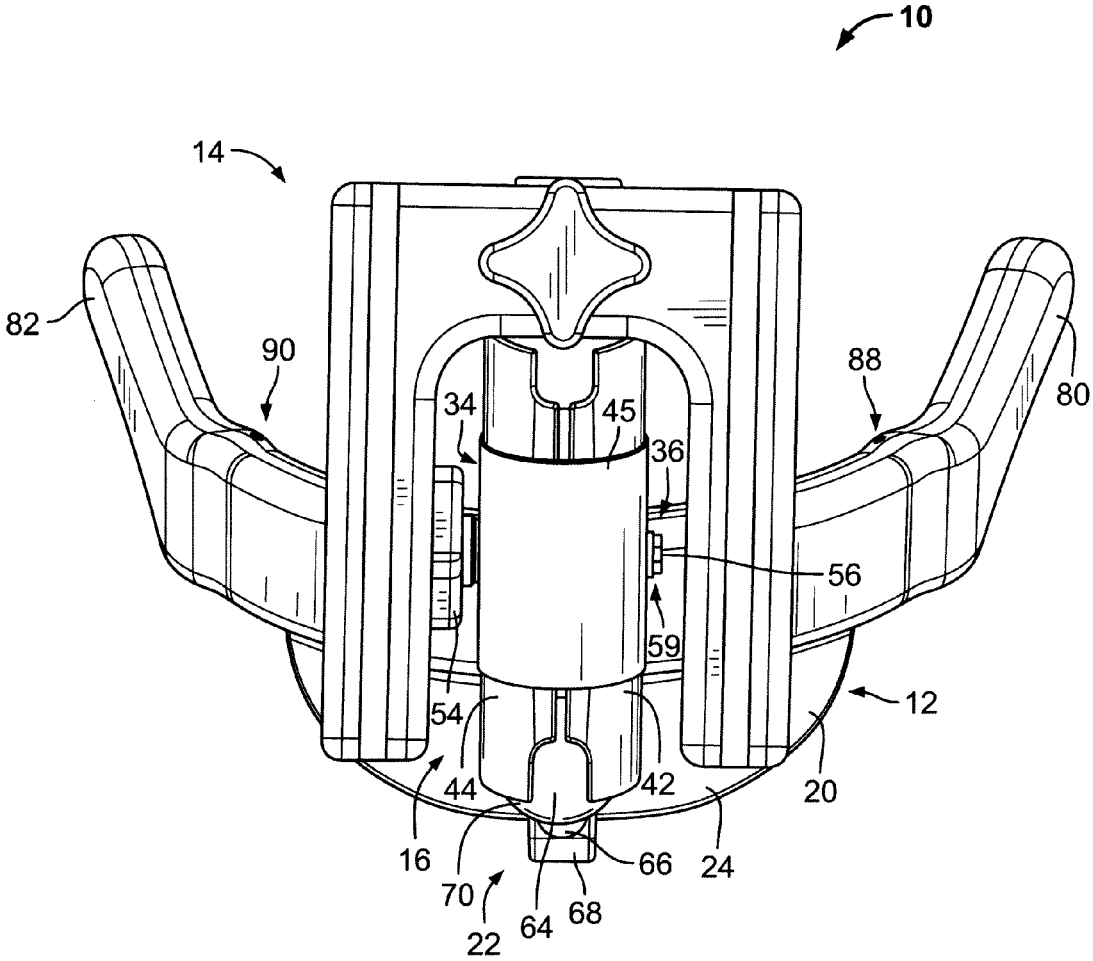
FIG. 6 is a rear elevation view of the surgical head support apparatus of FIG. 3 showing the first and second handles of the head support extending up and away from the head support headrest.

The head support 12 further includes a connection pad 103, a first strap 104, a second strap 106 (shown in FIGS. 3-5). The connection pad 103 is piece of male Velcro material, also known as hook material, covering a portion of a front side 105 of the headrest 20. The connection pad is configured to couple to a padded head support (not shown).

Additional details regarding the padded head support (not shown) are provided in U.S. application Ser. No. 12/948,818 which is filed concurrently herewith, which is titled "Padded Head Support for Surgery" and which is hereby incorporated by reference herein.

The first strap 104 includes a first side 108, a second side 110, a pull tab 112, and an attachment tab 114. The second strap 106 includes a first side 116 second side 118 pull tab 120 and an attachment tab 122. The first sides 108, 116, of the first and the second straps 104, 106, are male Velcro material, sometimes referred to as hook material. The second sides 110, 118, of the first and the second straps 104, 106, are female Velcro material, sometimes referred to as loop material. The pull tabs 112, 120, are situated at a first end 124 of the first and the second straps 104, 106, respectively. The attachment tabs 114, 122, are situated at a second end 126 of the first and the second straps 104, 106, respectively. The attachment tabs 114, 122, also include a coupling side 128 covered in female Velcro material.

When a patient's head is supported by the head support 12, the first and the second straps 104, 106, are coupled to the first and the second strap connectors 88, 90, and hold the patient's head against the curved headrest 20. The first and the second straps 104, 106, are coupled to the first and the second strap connectors 88, 90, by passing the attachment tabs 114, 122, through the first and the second slots 100, 102, and engaging the coupling sides 128 of the attachment tabs 114, 122, with the first sides 108, 116, of the first and the second straps 104, 106. To hold the patient's head against the curved headrest 20, the second strap 106 is passed over the front of a patient's head and pulled into contact with the head. Then the first strap 104 is passed over the second strap 106 and the first side 108 of the first strap 104 engages the second side 118 of the second strap 106. A shown in FIG. 5, the first and the second handles 80, 82, diverge outwardly with respect to the first and the second straps 104, 106, to provide a first space 105 and a second space 107 for accommodating a caregiver's fingers when the caregiver grips on or both of the first and the second handles 80, 82, for repositioning the head support 12.

The operating room table adapter apparatus 18 includes an adapter board 130, a first rail 132, and a second rail 134. The first rail 132 and the second rail 134 are coupled to the adapter board 130. The second rail 134 is spaced apart from and substantially parallel to the first rail 132. In the illustrative example, the first and the second rails 132, 134, are elongated cylindrical tubes. The first rail receiver 26 and the second rail receiver 28 are spaced apart and sized to receive the first rail 132 and the second rail 134, respectively.

The apparatus 10 is movable relative to the operating room table adapter 18. The first rail receiver 26 and the second rail receiver 28 of the bracket 14 are slidably coupled to the first rail 132 and the second rail 134, respectively, of the operating room table adapter 18. Thus, a caregiver need not act to reposition the surgical head support apparatus 10 relative to the operating room table adapter 18 when the operating room table adapter 18 is articulated with the surgical table (not shown).

Additional details regarding adapter apparatus 18 are provided in U.S. application Ser. No. 12/948,820 which is filed concurrently herewith, which is titled "Operating Room Table Adapter" and which is hereby incorporated by reference herein.

Although certain illustrative embodiments have been described in detail above, variations and modifications exist within the scope and spirit of this disclosure as described and as defined in the following claims.

The invention claimed is:

1. A surgical head support apparatus comprising a head support including a first spherical joint, a bracket including a second spherical joint, and a joint member coupling the head support to the bracket, the joint member including a joint member body and a joint lock, the joint member body having a joint member body first end forming a first socket and a joint member body second end forming a second socket, the first socket sized to receive the first spherical joint and the second socket sized to receive the second spherical joint, wherein the joint lock is operable to move the joint member between a locked configuration and an unlocked configuration, the locked configuration disallowing movement of the joint member relative to the first spherical joint and the second spherical joint, and the unlocked configuration allowing movement of the joint member relative to the first spherical joint and the second spherical joint and wherein the first spherical joint includes a first ball, a first shaft extending from the first ball, and a first flange coupled between the first shaft and the head support so that the shaft forms an angle relative to the head support of less than 90 degrees.

2. The surgical head support apparatus of claim 1, wherein the second spherical joint includes a second ball, a second shaft extending from the first ball, and a second flange coupled between the second shaft and the bracket so that the shaft forms an angle relative to the bracket of less than 90 degrees.

3. The surgical head support apparatus of claim 1, wherein the first spherical joint includes a first ball, the first ball being rubberized, and the second spherical joint includes a second ball, the second ball being rubberized.

4. The surgical head support apparatus of claim 1, wherein the joint lock includes a joint lock knob rotatable to move the joint member between the locked configuration and the unlocked configuration.

5. The surgical head support apparatus of claim 1, wherein the bracket is U-shaped and includes a first rail receiver, a second rail receiver, and a cross member coupled to the first rail receiver and the second rail receiver.

6. The surgical head support apparatus of claim 5, wherein the first rail receiver and the second rail receiver are slidably engaged with an operating room table adapter.

7. A surgical head support apparatus comprising a head support including a first spherical joint, a bracket including a second spherical joint, and a joint member coupled between the head support and the bracket, the joint member including a joint member body, the joint member body having a first joint member body portion and a second joint member body portion, wherein the first spherical joint and the second spherical joint are situated between the first joint member body portion and the second joint member body portion, and the first joint member body portion and the second joint member body portion are movable between a first position, where the first joint member body portion and the second joint member body portion are spaced apart a first distance and disallow movement of the joint member body relative to the first spherical joint and the second spherical joint, and a second position, where the first joint member body portion and the second joint member body portion are spaced apart more than the first distance and allow movement of the joint member body relative to the first spherical joint and the second spherical joint and wherein the first spherical joint includes a first ball, a first shaft extending from the first ball, and a first flange coupled between the first shaft and the head support so that the shaft forms an angle relative to the head support of less than 90 degrees.

8. The surgical head support apparatus of claim 7, wherein the second spherical joint includes a second ball, a second shaft extending from the second ball, and a second flange coupled between the second shaft and the bracket so that the shaft forms an angle relative to the bracket of less than 90 degrees.

9. The surgical head support apparatus of claim 7, wherein the first spherical joint includes a first ball, the first ball being rubberized, and the second spherical joint includes a second ball, the second ball being rubberized.

10. The surgical head support apparatus of claim 7, wherein the joint member body includes a first socket sized to receive the first spherical joint and a second socket sized to receive the second spherical joint, the first socket and the second socket defined by the first joint member body portion and the second joint member body portion.

11. The surgical head support apparatus of claim 7, wherein the joint member further includes a joint lock operable to move the first joint member body portion and the second joint member body portion between the first and the second position.

12. The surgical head support apparatus of claim 11, wherein the joint lock includes a joint lock bolt, extending through the first joint member body portion and the second joint member body portion, and a joint lock knob threadedly engaged with an end of the joint lock bolt.

13. A surgical head support apparatus comprising a head support including a first head support handle, a second head support handle, and a headrest coupled between the first head support handle and the second head support handle, a bracket, and a joint member coupling the head support to the bracket for movement in three dimensions relative thereto, wherein the first head support handle extends in a plane tangent to a curve defined by the head rest, and the first head support handle and the second head support handle extend above a top surface of the headrest.

14. The surgical head support apparatus of claim 13, wherein a bottom surface of the headrest extends below the first head support handle and the second head support handle.

15. The surgical head support apparatus of claim 14, wherein the first head support handle, the second head support handle, and the headrest are unitarily formed from a polymeric material.

16. The surgical head support apparatus of claim 13, wherein the head support further includes a first removable head strap and a second removable head strap.

17. The surgical head support apparatus of claim 16, wherein the first head strap and the second head strap include an inner surface and an outer surface, wherein the inner surface is covered in hook material and the outer surface is covered in loop material.

18. The surgical head support apparatus of claim 16, wherein the head support includes a first strap guide opening and a second strap guide opening, the first strap extending through the first strap guide opening and the second strap extending through the second strap guide opening.

19. The surgical head support apparatus of claim 13, wherein the second head support handle extends in a second plane tangent to the curve.

20. A surgical head support apparatus comprising a head support including a first head support handle, a second head support handle, and a headrest coupled between the first head support handle and the second head support handle, a bracket, and a joint member coupling the head support to the bracket for movement in three dimensions relative thereto, wherein the first head support handle and the second head support handle extend outside of a footprint of the headrest when viewed from above and the first head support handle and the second head support handle extend above a top surface of the headrest when viewed from the side.

* * * * *